US009855665B2

(12) United States Patent
Marchev et al.

(10) Patent No.: US 9,855,665 B2
(45) Date of Patent: Jan. 2, 2018

(54) STRENGTHENED RAZOR BLADE

(71) Applicant: The Gillette Company LLC, Boston, MA (US)

(72) Inventors: Krassimir Grigorov Marchev, Sudbury, MA (US); John Madeira, Assonet, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 15/415,147

(22) Filed: Jan. 25, 2017

(65) Prior Publication Data

US 2017/0129117 A1 May 11, 2017

Related U.S. Application Data

(62) Division of application No. 12/471,551, filed on May 26, 2009, now Pat. No. 9,598,761.

(51) Int. Cl.

| | |
|---|---|
| ***B26B 21/60*** | (2006.01) |
| ***C23C 8/38*** | (2006.01) |
| ***B26B 21/56*** | (2006.01) |

(52) U.S. Cl.

CPC ..... *B26B 21/60* (2013.01); *B26B 21/56* (2013.01); *C23C 8/38* (2013.01)

(58) Field of Classification Search

CPC ..... B26B 21/60

See application file for complete search history.

(56) References Cited

U.S. PATENT DOCUMENTS

| | | | |
|---|---|---|---|
| 2,087,051 | A | 7/1937 | Stargardter |
| 3,208,885 | A | 9/1965 | Muller |
| 3,743,551 | A | 7/1973 | Sanderson |
| 4,242,151 | A | 12/1980 | Leveque |
| 4,495,003 | A | 1/1985 | Kubo |
| 4,969,378 | A | 11/1990 | Lu et al. |
| 5,226,975 | A | 7/1993 | Denton et al. |
| 5,295,305 | A | 3/1994 | Hahn et al. |
| 5,849,158 | A | 12/1998 | Costello et al. |
| 6,090,223 | A | 7/2000 | Kiuchi et al. |
| 6,440,230 | B1 | 8/2002 | Klein |
| 6,589,414 | B2 | 7/2003 | Klein |
| 6,684,513 | B1 | 2/2004 | Clipstone et al. |
| 7,060,367 | B2 | 6/2006 | Yamada et al. |
| 7,438,769 | B2 | 10/2008 | Ko et al. |
| 7,556,699 | B2 | 7/2009 | Cooper et al. |
| 7,966,909 | B2 | 6/2011 | Madeira et al. |
| 2004/0262847 | A1 | 12/2004 | Inoue |
| 2005/0236070 | A1 | 10/2005 | Blaauw et al. |
| 2005/0241159 | A1 | 11/2005 | Blaauw et al. |
| 2006/0048857 | A1 | 3/2006 | Cooper et al. |
| 2006/0048858 | A1 | 3/2006 | Cooper et al. |
| 2006/0201001 | A1 | 9/2006 | Teeuw et al. |
| 2006/0277767 | A1 | 12/2006 | Sun et al. |
| 2008/0076001 | A1 | 3/2008 | Uchiyama et al. |
| 2009/0025512 | A1 | 1/2009 | Madeira et al. |
| 2009/0035481 | A1 | 2/2009 | Ko et al. |
| 2010/0299931 | A1 | 12/2010 | Marchev et al. |

FOREIGN PATENT DOCUMENTS

| | | |
|---|---|---|
| JP | 05-311396 | 11/1993 |
| JP | 07-109561 | 4/1995 |
| WO | WO 2006/079360 A1 | 8/2006 |
| WO | WO 2006/079361 A1 | 8/2006 |
| WO | WO 2006/106429 A2 | 10/2006 |
| WO | WO 2008/123341 A1 | 10/2008 |
| WO | WO 2010/138369 | 12/2010 |

OTHER PUBLICATIONS

Xi, Y.T., Liu, D.X. and Han, D. "Improvement of Mechanical Properties of Martensitic Stainless Steel by Plasma Nitriding at Low Temperature." *ACTA Metallurgica Sinica* (*English Letters*) vol. 21 No. 1 (Feb. 2008) : 21-29.

Marchev, K., Cooper, C.V., and Giessen, B.C. "Observation of a compound layer with very low friction coefficient in ion-nitrided martensitic 410 stainless steel." *Surface and Coatings Technology* 99 (1998) 229-233.

Kwietniewski C et al: "Nitrided layer embrittlement due to edge effect on duplex treated AISI M2 high-speed steel" Surface and Coatings Technology, vol. 179, No. 1, Jul. 12, 2003 (Jul. 12, 2003), pp. 27-32, XP008058850 Elsevier, Amsterdam [NL], ISSN: 0257-8972 DOI: 10.1016/S0257-8972(03)00795-3, pp. 27-32; figures 2, 3; table 1.

PCT International Search Report with Written Opinion in corresponding Int'l appln. PCT/US2010/035532 dated Oct. 8, 2010.

*Primary Examiner* — Roy King
*Assistant Examiner* — Jophy S Koshy
(74) *Attorney, Agent, or Firm* — Joanne N. Pappas; Kevin C. Johnson; Steven W. Miller

(57) ABSTRACT

A razor blade including a substrate with a cutting edge, the substrate includes a mixed nitride-substrate interregion disposed at or beneath a surface of the substrate, the mixed nitride-substrate interregion being substantially free of a compound layer.

13 Claims, 2 Drawing Sheets

STRENGTHENED RAZOR BLADE

FIELD OF THE INVENTION

The present invention relates to a strengthened razor blade and a method of strengthening such razor blade.

BACKGROUND OF THE INVENTION

In order to improve the chemical and mechanical properties of a substrate, e.g., hardness, wear resistance, corrosion resistance, and fatigue resistance, the substrate, such as one used for a razor blade, have hard coatings applied to the substrate, particularly at a cutting edge. For razor blades, these hard coatings, which are typically applied on the cutting edge, serve two major roles, namely to strengthen the razor blade, which allows for slimmer profiles, and to provide a suitable interface for the adhesion of a telomer coating. Generally, the thinner the razor blade becomes at its cutting edge, the lower the cutting force and the better the razor blade's cutting attributes. Examples of cutting edge structures comprising lower cutting forces are described in U.S. Pat. Nos. 5,295,305; 5,232,568; 4,933,058; 5,032,243; 5,497,550; 5,940,975; 5,669,144; 5,217,010; and 5,142,785. The properties of the resulting razor blade greatly depend on the strength and the hardness of both the underlying substrate and the coating.

Deflection or bending of the razor blade is a major factor in providing a close and comfortable shave to a user. Some of the discomfort during and after shaving, usually due to nicking, results from excessive stiffness of the razor blade because of the coatings, e.g., amorphous diamond, that are present. This phenomenon is due to the hard coatings actually changing the profile of the razor blade's cutting edge because the thickness is typically higher towards the tip.

Typically, the hard coatings on a razor blade's cutting edge have a multilayered structure. These layers are usually selected and optimized to provide sufficient strength and adhesion of a fluoropolymer-containing, e.g., polytetrafluoroethylene (PTFE), coating. However, these coatings are not optimized to provide appropriate strength and flexibility to the underlying substrate itself. While the hard coating may contribute to the overall strength of the razor blade, neither of these coatings contribute to minimizing the coating thickness.

Instead of adding a hard coating, there have been attempts at hardening the substrate by nitriding, which is a technique used to strengthen ferrous and non-ferrous materials. When applied to steel substrates, such as those used for razor blades, compound layers of various Fe—N phases, namely the cubic gamma prime ($Fe_4N$) phase or the hexagonal epsilon ($Fe_{2-3}N$) phase, are produced. However, these gamma prime and epsilon phases do not actually increase the strength of the underlying substrate, but instead produce a brittle substrate surface, particularly at the cutting edge, because of byproduct growth or hillocks that are formed. If the cutting edge breaks on a razor blade, the remaining razor blade will yield an extremely uncomfortable shave.

One of the major advantages of plasma nitriding over gas and salt-bath nitriding is the process control. By controlling the power and the gas composition, the phase composition, layer structure and its thickness as well as other properties of treated stainless steel substrates can be controlled. For example, nitriding stainless steel increases the abrasion resistance of the underlying steel as well as improves the fatigue strength and reduces the friction coefficient.

Accordingly, it would be advantageous to produce an improved razor blade, which does not include the gamma prime or epsilon phases. Instead, the improved razor blade includes a mixed nitride-substrate interregion that contains a solid solution of nitrogen, which does not materially alter the original razor blade profile. This configuration provides improved razor blade properties, such as a slimmer cutting edge. Furthermore, it would also be advantageous to improve the shaving performance by lowering the cutting force of the razor blade's cutting edge. This could be achieved by applying a significantly thinner hard coating, or possibly eliminating it by strengthening the substrate prior to applying the hard coating.

SUMMARY OF THE INVENTION

In an aspect, the present invention relates to a razor blade comprising a substrate with a cutting edge, the substrate comprising a mixed nitride-substrate interregion disposed at or beneath a surface of the substrate, the mixed nitride-substrate interregion being substantially free of a compound layer.

In another aspect, the present invention relates to a method for strengthening a razor blade comprising the steps of: (a) providing a substrate comprising a cutting edge in a vacuum chamber; (b) supplying into the vacuum chamber a nitrogen-containing gas mixture comprising between about 1-12% by volume of nitrogen and between about 88-99% by volume of hydrogen; and (c) nitriding the substrate with the nitrogen-containing gas mixture to form a mixed nitride-substrate interregion disposed at or beneath a surface of the substrate.

Other features and advantages of the invention will be apparent from the description and drawings, and from the claims.

DETAILED DESCRIPTION OF THE INVENTION

The term "solid solution" refers to a type of alloying which can be used to improve the strength of a substrate, but which does not affect the overall crystal structure of the substrate. As used herein, the term "solid solution," commonly referred to as an interstitial solid solution, works by adding solute ions and/or atoms of one element to the crystalline lattice of a substrate. Without being limited by theory, this "solid solution" may be accomplished because the solute ions and/or atoms are much smaller than the atoms that form the crystalline lattice of the substrate thereby allowing the solute ions and/or atoms to diffuse into the crystalline lattice structure of the substrate without materially changing the overall crystal structure of the substrate.

As used herein, the term "coating" means a covering, including a free film, an impregnation, or the like, that is applied to an object or substrate, such that the covering may be continuous, discontinuous, may have a single or varying thicknesses, or may exist in a single or multiple planes.

Figure 1:
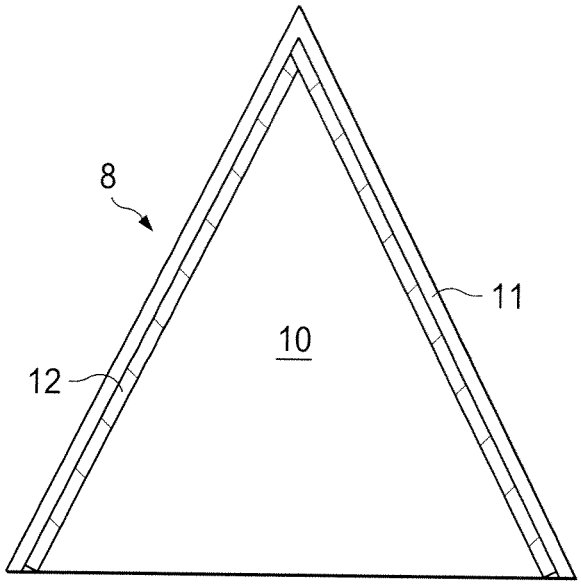
FIG. 1 is a diagrammatic view illustrating an example of a razor blade including a mixed nitride-substrate interregion in accordance with the present invention.

FIG. 1 shows a razor blade (8) comprising a substrate (10) with a cutting edge (11). The substrate (10) comprises a mixed nitride-substrate interregion (12) disposed at or beneath a surface of the substrate (10) such that the mixed nitride-substrate interregion (12) is substantially free of a compound layer. For example, as described above, in a steel substrate, the mixed nitride-substrate interregion (12) is substantially free of various Fe—N phases like the cubic gamma prime ($Fe_4N$) phase or the hexagonal epsilon ($Fe_{2-3}N$) phase. Instead, this mixed nitride-substrate interregion (12) may consist essentially of a solid solution of nitrogen in the substrate (10). The present invention is not intended to be limited to a razor blade (8). For example, the substrate (10) may take the form of a knife, a surgical instrument, or the like.

Generally, the thickness of the mixed nitride-substrate interregion (12) may range from about 0.01 μm to about 200 μm. For example, the mixed nitride-substrate interregion (12) may have a thickness from about 0.01, 0.05, 0.1, 0.3, 0.5, 0.7, 0.8, 1, 1.3, 1.6, 1.8, 2, 2.25, 2.5, or 2.75 μm to about 3.25, 3.5, 3.75, 4, 4.25, 4.5, 4.75, 5, 5.25, 5.5, 5.75, 6, 6.25, 6.5, 7, 7.5, 8, 8.5, 10, 15, 20, 25, 35, or 40 μm or even to about 60, 70, 80, 90, 100, 125, 150, 165, 180, or about 200 μm. In a particular embodiment, the thickness of the mixed nitride-substrate interregion (12) is about 3 μm.

The mixed nitride-substrate interregion (12) may be formed by plasma nitriding a surface of the substrate (10) with nitrogen ions and/or atoms. For example, the substrate (10) may comprise a material such as stainless steel. AISI 440 and fine carbide (FC-15) are particularly well-suited substrate materials. For example, in an AISI 440 steel substrate (10), considering the relatively small size of nitrogen ions and/or atoms, about 0.75 Angstroms, compared to the ferrous elements, which are about 1.25 Angstroms, in the substrate (10), introduction of the nitrogen ions and/or atoms into solid solutions predominantly affects the level of compression stress in that mixed nitride-substrate interregion (12). Additionally, plasma nitriding improves mechanical properties of the substrate (10) including increasing the hardness, the wear resistance, and the corrosion resistance. In addition to increasing the substrate's (10) abrasion resistance, the mixed nitride-substrate interregion (12) also improves the fatigue strength and reduces the friction coefficient.

Plasma nitriding is an advanced surface hardening process that utilizes nitrogen ions and/or atoms. This process alters the surface composition of a substrate (10) by introducing a certain amount of nitrogen at and/or beneath the surface of the substrate (10) from a nitrogen-containing plasma. To form the mixed nitride-substrate interregion (12) of the solid solution of nitrogen without having the undesired gamma prime and epsilon phases, the volume of nitrogen in the nitrogen-containing gas mixture is controlled. This may be accomplished by using between about 1-12% by volume of nitrogen and between about 88-99% by volume of hydrogen. For example, the volume of nitrogen may be between about 3-10% and the volume of hydrogen may be between about 90-97%. In a particular embodiment, the volume of nitrogen is 10% and the volume of hydrogen is 90%.

Other gases may also be introduced into the chamber along with the nitrogen-containing gas mixture so long as the other gases do not interfere with the formation of the mixed nitride-substrate interregion (12). Examples of other gases that may be present are a carbon-containing gas, e.g., methane gas, a boron-containing gas, e.g., boron gas, an inert gas, or the like. Generally, gases that oxidize a substrate (10), e.g., oxygen, need to be avoided to prevent formation of the gamma prime phase, epsilon phase, or other byproduct growths or hillocks.

Generally, the thermal history of the substrate (10) is a major limiting factor that determines the upper temperature limit to which the substrate (10) may be exposed, particularly during plasma nitriding. This is particularly important when the substrate (10) comprises a heat-treated alloy or steel, such as martensitic stainless steel, which incorporates high-temperature annealing, quenching and stress leave treatment. Overheating of such alloys will lead to degradation of substrate properties, lower hardness and strength. To avoid this from happening to these particular types of alloys or steel, it is important that the plasma nitriding temperature be kept below about 550° C. For example, in martensitic stainless steel, the nitriding may be performed at a temperature ranging between about 350° C. to about 549° C. More specifically, the temperature may be about 350, 375, 400, 425, 450, 465, or 475° C. to about 490, 500, 515, 530, 540° C. or about 549° C. In a particular embodiment, the temperature is about 480° C. However, for other types of substrates the temperature range may vary.

Figure 2:
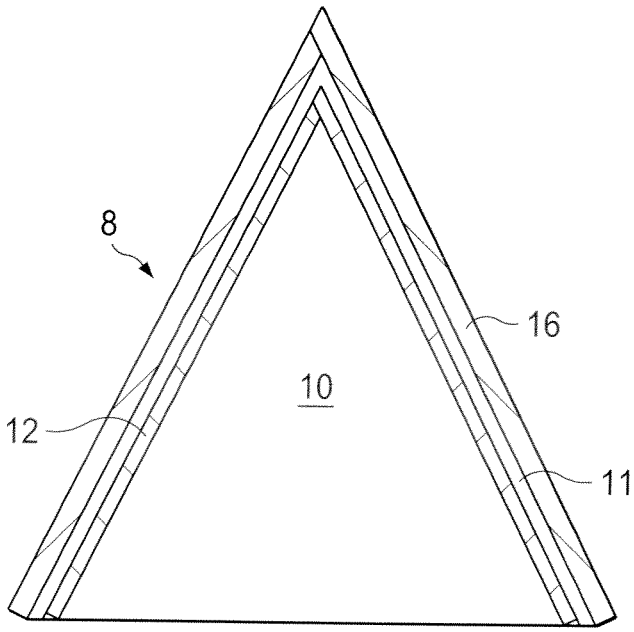
FIG. 2 is a diagrammatic view of FIG. 1 further including a first coating.

In another embodiment, as shown in FIG. 2, a first coating (16) may also be disposed over the surface of the substrate (10), generally positioned above the mixed nitride-substrate interregion (12). The present invention is not limited to using a single first coating (16), i.e., multiple first coatings (16) may be applied. The first coating (16) generally provides improved strength and corrosion resistance. Applied to a razor blade (8), the first coating (16) improves shaving ability as well as reduces rounding of the tip of the substrate (10). The first coating (16) may comprise a material selected from the group consisting of a metal, a metal alloy, a metal carbide, a metal oxide, a metal nitride, diamond, amorphous diamond, diamond-like carbon, boron, boron nitride, derivatives and combinations thereof. For example, the metal may be selected from the group consisting of Al, Ta, Ru, Ni, V, Ti, Pt, Cr, Nb, Hf, W, Zr, Ag, Re, Pd, Fe, and combinations thereof. Other suitable metals may also be used.

As described in the "Handbook of Physical Vapor Deposition (PVD)," DLC is an amorphous carbon material that exhibits many of the desirable properties of diamond but does not have the crystalline structure of diamond. Examples of suitable materials such as niobium and chromium containing materials, pure or doped carbon containing materials (e.g., diamond, amorphous diamond or DLC), nitrides (e.g., boron nitride, niobium nitride or titanium nitride), carbides (e.g., silicon carbide), oxides (e.g., alumina, zirconia) or other ceramic materials, for the first coating (16) are described in U.S. Pat. Nos. 5,295,305 and 6,684,513. U.S. Pat. No. 5,232,568 also describes suitable DLC layers and methods of depositing those layers.

The first coating (16) may be applied by sputtering using a DC bias (more negative than about −50 volts or even more negative than about −200 volts) and pressure of about 2 millitorr argon. Without being limited by theory, the increased negative bias promotes a compressive stress (as opposed to a tensile stress) in the first coating (16).

Alternatively, the first coating (16) may be applied by generating ions from their respective material by applying a negative voltage to the material in pulses, as described in U.S. Pat. No. 7,966,909, which is commonly owned and assigned to THE GILLETTE COMMPANY®. In an embodiment, the first coating (16) may comprise chromium and have a thickness of between about 100 and about 700

Angstroms. For example, the first coating (16) may have a thickness from about 100, 125, 150, 175, 200, 225, 250, or 275 Angstroms to about 325, 350, 375, 400, 450, 500, 550, 600, 650, or 700 Angstroms. In a particular embodiment, the first coating (16) has a thickness of about 300 Angstroms.

Additionally, the cutting edge (11) may comprise a wedge-shaped tip that has an included angle of less than thirty degrees and a tip radius of less than 1,000 Angstroms. Generally, for a razor blade (8), the tip radius may be between about 200 and about 500 Angstroms, as measured by SEM, after application of the first coating (16). For example, the tip radius may be between about 100, 125, 150, 175, 200, 225, 240, 250, 265, 275, or 290 Angstroms to about 310, 325, 340, 355, 375, 400, 450, or 500 Angstroms. In a particular embodiment, the tip radius is about 300 Angstroms.

Figure 3:
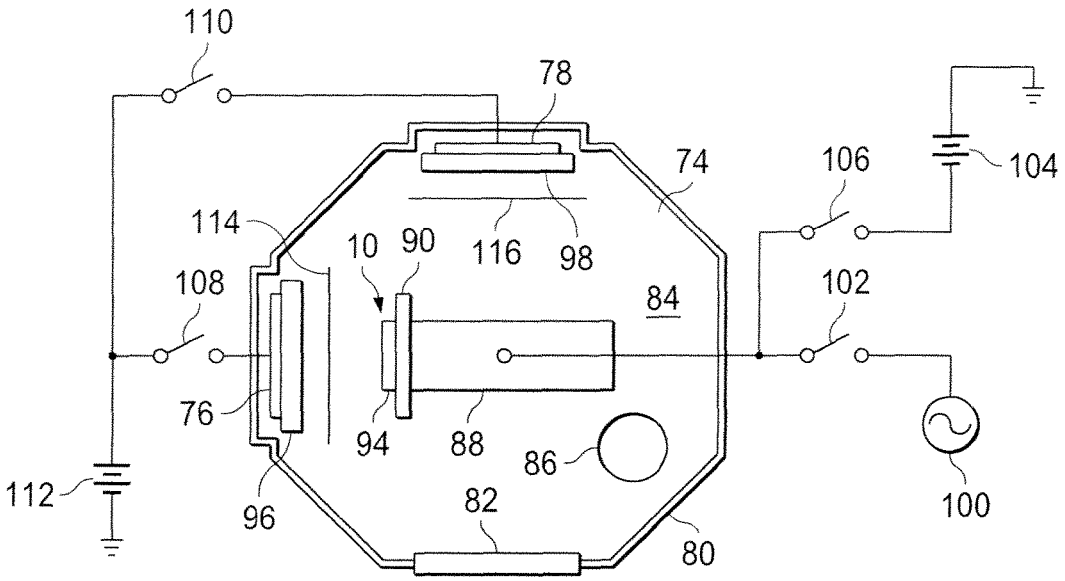
FIG. 3 is a diagrammatic view of an exemplary apparatus for applying a first coating in accordance with the present invention.

FIG. 3 shows an exemplary apparatus for applying the first coating (16), as shown in FIG. 2. The apparatus includes a DC planar magnetron sputtering system manufactured by Vac Tec Systems of Boulder, Colo. that has a stainless steel chamber (74) with a wall structure (80), a door (82) and a base structure (84) in which is formed a port (86) coupled to a suitable vacuum system (not shown). Mounted in the chamber (74) is a carousel support (88) with an upstanding support member (90) on which a stack of substrates (10) may be disposed. The substrates (10) may typically have the surface portion (14) in alignment and facing outwardly from the support member (90).

Also disposed in the chamber (74) is a support structure (76) for a target (96), e.g., a first coating material (16). An additional support structure (78) for another target (98) may also be disposed in the chamber (74). The targets (96, 98) may be vertically disposed plates, each about twelve centimeters wide and about thirty-seven centimeters long. The support structures (76, 78 and 88) are electrically isolated from the chamber (74) and electrical connections are provided to connect the substrate (10) to a RF power supply (100) through a switch (102) and to a DC power supply (104) through a switch (106). The targets (96, 98) are also connected through switches (108, 110), respectively, to a DC magnetron power supply (112). A shutter structure (114, 116) is disposed adjacent targets (96, 98), respectively, for movement between an open position and a position obscuring the adjacent target.

A carousel (88) may support the substrate (10) and may be spaced about seven centimeters from the opposed target plate (96, 98). The carousel (88) is rotatable about a vertical axis between a first position in which the substrate (10) may be in opposed alignment with the target (96), shown in FIG. 3, and a second position in which the substrate (10) may be in opposed alignment with the other target (98).

Figure 4:
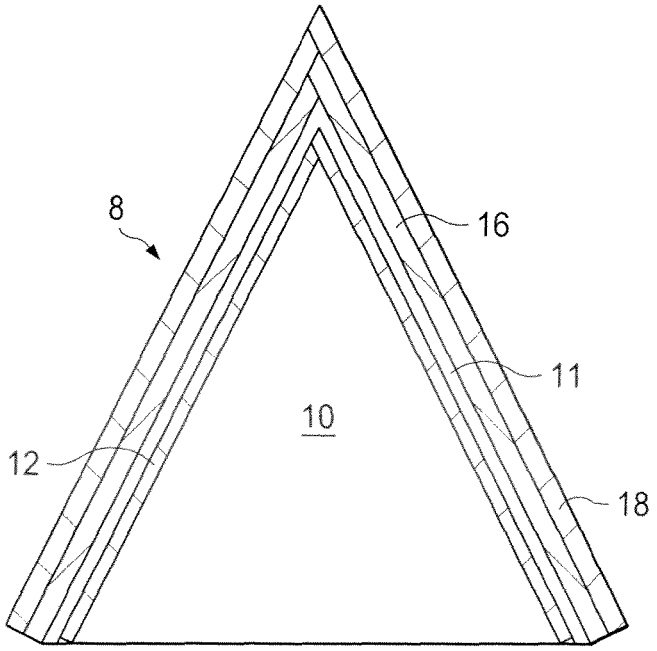
FIG. 4 is a diagrammatic view of FIG. 2 further including a second coating.

As shown in FIG. 4, a second coating (18) may be disposed over the first coating (16). In general, the second coating (18) reduces friction at its surface and generally includes a fluoropolymer-containing material, e.g., polytetrafluoroethylene (PTFE), otherwise known as a telomer. Alternatively, the second coating (18) may be disposed over the surface of the substrate (10), generally near the cutting edge (11), not shown. In general, the first coating (16) facilitates the bonding of the second coating (18) to the substrate (10). Additionally, it is known that when a generally continuous second coating (18) is applied, a reduced telomer coating thickness can provide improved first shave results. For a razor blade (8), the second coating (18) generally has a thickness between about 100 and about 5,000 Angstroms.

KRYTOX® LW 1200, which is available from DuPont, is a suitable PTFE material that may be used. KRYTOX® LW 1200 is a nonflammable and stable dry lubricant that consists of small particles that yield stable dispersions. It is furnished as an aqueous dispersion of 20% solids by weight and can be applied by dipping, spraying, or brushing, and can thereafter be air dried or melt coated. For example, the second coating (18) may be formed by heating the substrate (10) in a neutral atmosphere of argon and providing an adherent and friction-reducing polymer coating of solid PTFE, as described in U.S. Pat. Nos. 5,295,305 and 3,518,110. Utilizing the technique described in the aforementioned patents results in the second coating (18) generally having a thickness from about 1000, 1100, 1200, 1300, 1400, 1500, 1600, 1700, 1750, 1800, 1850, 1900, 1950, or 1975 Angstroms to about 2025, 2050, 2100, 2150, 2200, 2600, 3000 or 5000 Angstroms. In a particular embodiment, the second coating (18) has a thickness of about 2000 Angstroms. Alternatively, U.S. Pat. Nos. 5,263,256 and 5,985,459 describe other techniques which may be used to reduce the thickness of an applied telomer layer. Utilizing these other techniques, the second coating (18) may have a thickness from about 100, 120, 140, 150, 165, 175, 185, or 190 Angstroms to about 210, 225, 250, 275, 300, 350, 400, 500, 600, 800, 1000, 1200, or 1500 Angstroms. In a particular embodiment, the second coating (18) has a thickness of about 200 Angstroms.

The present invention also relates to a method for strengthening a razor blade. This method may also be used to produce the previously described razor blade comprising the mixed nitride-substrate interregion. The substrate may comprise a material such as stainless steel. AISI 440 or fine carbide (FC-15) are particularly well-suited substrate materials. In an embodiment, the cutting edge may comprise a wedge-shaped tip that has an included angle of less than thirty degrees and a tip radius of less than 1,000 Angstroms, as described in U.S. Pat. Nos. 5,295,305 and 6,684,513. For example, the tip radius may be about 100, 125, 150, 175, 200, 225, 240, 250, 265, 275, or 290 Angstroms to about 310, 325, 340, 355, 375, 400, 450, 500, 600, 700, 800, 900, or 999 Angstroms. In a particular embodiment, the tip radius is about 300 Angstroms.

The method comprises the steps of: (a) providing a substrate comprising a cutting edge in a vacuum chamber; (b) supplying into the vacuum chamber a nitrogen-containing gas mixture comprising between about 1-12% by volume of nitrogen and between about 88-99% by volume of hydrogen; and (c) nitriding the substrate with the nitrogen-containing gas mixture to form a mixed nitride-substrate interregion disposed at or beneath a surface of the substrate.

In an embodiment, step (c) may be performed by plasma nitriding. In another embodiment, the mixed nitride-substrate interregion comprises a solid solution of nitrogen in the substrate. To form the mixed nitride-substrate interregion of the solid solution of nitrogen substantially free of the undesired gamma prime and epsilon phases, the volume of nitrogen in the nitrogen-containing gas mixture is controlled. This may be accomplished by using between about 1-12% by volume of nitrogen and between about 88-99% by volume of hydrogen. For example, the volume of nitrogen may be between about 3-10% while the volume of hydrogen ranges from about 90-97%. In a particular embodiment, the volume of nitrogen is 10% and the volume of hydrogen is 90%.

Before step (b), the method may also include step (d) supplying a cleaning gas mixture into the vacuum chamber and cleaning the surface portion of the substrate with a cleaning gas mixture. The cleaning gas mixture may comprise a gas selected from the group consisting of hydrogen, argon, and combinations thereof. Depending on the type of substrate material, cleaning with hydrogen gas may be more suitable because argon may damage the surface of the substrate. In general, step (d) is performed at a lower pressure and a higher voltage than steps (b) and/or (c).

In an exemplary processing sequence, the cleaning, i.e., step (d), and nitriding, i.e., steps (b and c), cycle begins by placing the substrate into the vacuum chamber and evacuating the chamber to a desired vacuum pressure. Upon reaching the desired vacuum, e.g., from about 0.1 torr to less than about 2.0 torr, the unit is back-filled with a cleaning gas mixture to begin the preheating cycle. The standard preheating cycle ranges in temperature from about 350° C. to about 549° C., as described above. In a particular embodiment, the temperature is about 480° C. When the preset heating time has elapsed, e.g., about 1-15 minutes, the substrate is subjected to an ion bombardment to clean impurities from the surface. The cleaning gas mixture is ionized by a voltage that is applied to the substrate. This ionized gas collides with the product removing impurities from the surface and preparing the substrate for the nitriding process to begin.

For example, step (d) may be by reactive ion etching (RIE). RIE uses chemically reactive plasma to remove material deposited on a substrate. Generally, the plasma is generated under low pressure (vacuum) by an electromagnetic field. High-energy ions from the plasma react with the surface of the substrate. The plasma may be formed by applying a strong radio frequency (RF) electromagnetic field to the substrate. For example, the RF may be about 13.56 MHz and applied at a few hundred watts. The oscillating electric field created by the RF ionizes the gas molecules by stripping them of electrons, thereby creating the plasma.

In each cycle of the electric field, the electrons are electrically accelerated in the chamber. Electrons absorbed into the substrate cause the substrate to build up charge. This charge build up develops a large negative voltage on the substrate, typically around a few hundred volts. The plasma itself develops a slightly positive charge due to the higher concentration of positive ions compared to free electrons. Because of the large voltage difference, positive ions tend to drift toward the substrate to be etched. The ions react chemically with the materials on the surface of the substrate as well as knock off (sputter) some material by transferring some of their kinetic energy.

When the substrate surface is cleaned sufficiently, the nitriding cycle begins. A controlled flow of a nitrogen-containing gas mixture is introduced into the vacuum chamber, typically at a pressure ranging from about 2 torr to about 5 torr, while a strong electrostatic field is established between at least the substrate, namely the surface portion, and an electrode. As a result of the electrostatic field, the nitrogen-containing gas mixture is ionized, which causes the nitrogen ions and/or atoms to accelerate toward and at least partially diffuse into the surface of the substrate to form the mixed nitride-substrate interregion. This nitriding cycle is continued for about 2 to about 72 hours until the desired case thickness is achieved. The processing time is dependent upon the composition of the steel being nitrided and the required thickness of the mixed nitride-substrate interregion.

In another embodiment, as previously described, a first coating may also be applied over the surface of the substrate, i.e., generally above the mixed nitride-substrate interregion. In another embodiment, a second coating of a fluoropolymer-containing material may be applied over the first coating, or, in the absence of a first coating, directly over the surface of the substrate.

In order to illustrate the invention, various examples are set forth below. It will be appreciated, however, that these are intended to be illustrative and are not intended to be limiting.

EXAMPLES

The following Examples use AISI 440 stainless steel substrates that are quadrant-shaped and are about 8 mm thick. Prior to nitriding, the substrate samples are cleaned by sputtering the substrate samples cathodically at low chamber pressures of between about 0.3 and about 0.5 torr at a minimal flow of $H_2$ gas of approximately 5 $cm^3$/min, a very high potential of up to about 900 V, and a low current of about 1 A.

Example 1

The cleaned substrate samples are plasma nitrided to form the mixed nitride-substrate interregion. Plasma nitriding treatments are performed in a direct current (DC) plasma at specimen temperatures between about 350° C. and about 549° C. in a gas mixture of about 10% $N_2$ and about 90% $H_2$. During the nitriding stage, a higher pressure, e.g. about 2.7-2.8 torr, than that used for sputtering is maintained. Nitriding durations varied between about 6 and 120 hours. After completing the process, samples are slowly cooled in situ to temperatures below 60° C. to minimize surface oxidation.

Example 2

The substrate samples from Example 1 are cleaned by sputtering at a pressure of about 10 millitorr, about 120 $cm^3$/min flow of $N_2$ gas, 13.56 MHz RF bias of about nine hundred watts. Then, a first coating is then added to the substrate samples.

The following exemplary process for adding the first coating is conducted on a DC planar magnetron sputtering system manufactured by Vac Tec Systems of Boulder, Colo., as described above and depicted in FIG. 3. The substrate from Example 1 is secured on support (90) and the chamber (74) is evacuated. A niobium target (96) and a graphite target (98) are cleaned by DC sputtering for five minutes. The argon flow is adjusted to 150 sccm at a pressure of 2.0 millitorr in the chamber (74). The switch (106) is closed to apply a DC bias of −25 volts on substrate (10) and the switch (108) is closed to commence sputtering at one kilowatt power. The shutter (114) in front of the niobium target (96) is opened for thirty seconds to deposit the niobium on the surface of the substrate (10).

The pressure in chamber (74) is maintained at two millitorr with an argon flow of 150 sccm. The switch (110) is closed to sputter the graphite target (98) at 750 watts. The switch (102) is closed to apply a 13.56 MHz RF bias of eight hundred watts (−420 volts DC self bias voltage) on the substrate (10). At the same time, shutter (116) is opened for twenty minutes to deposit a DLC material, i.e., a first coating, of about 2,000 Angstroms thickness on the surface of the substrate (10).

Example 3

A second coating is then added to the substrate of Example 2 by heating the substrate (10) in a neutral atmosphere of argon and applying a coating of PTFE.

Example 4

A second coating is then added to the substrate samples of Example 1 by the process described in Example 3.

Without being limited by theory, the micro-hardness of the substrate samples before and after plasma nitriding (Example 1) are determined by using an ASTM E-384 test, which is the standard for measuring the resistance of a material to deformation. According to the present invention, this test is performed using a Mitutoyo HM-124 testing machine with a 0.05 kg load at 10 second intervals. The substrate samples before nitriding have an average Vickers hardness of 640 HV and the substrate samples after nitriding (Example 1) have an average Vickers hardness of 1486 HV. These results indicate that the nitrided substrate samples are considerably harder and stronger than the non-nitrided substrate samples. These results suggest that a slimmer profile substrate may be used for the razor blade without sacrificing the strength of the underlying substrate. In addition, these results indicate that the coating thickness on the substrate may be reduced or eliminated without sacrificing the strength of the overall razor blade.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for strengthening a razor blade comprising the steps of:

a. providing a substrate comprising a cutting edge in a vacuum chamber;

b. supplying into the vacuum chamber a nitrogen-containing gas mixture comprising between about 1-12% by volume of nitrogen and between about 88-99% by volume of hydrogen; and c. nitriding the substrate with the nitrogen-containing gas mixture to form a mixed nitride-substrate interregion disposed at or beneath a surface of the substrate;

wherein the razor blade comprises the substrate with the cutting edge, the substrate comprising the mixed nitride-substrate interregion disposed at or beneath the surface of the substrate, the mixed nitride-substrate interregion and the substrate being free of gamma prime or epsilon phases.

2. The method of claim 1 further comprising a step of:

(d) supplying a cleaning gas mixture into the vacuum chamber and cleaning a surface portion of the substrate with a cleaning gas mixture, wherein the step of (d) is performed after the step of (a) and before the step of (b).

3. The method of claim 1 wherein the mixed nitride-substrate interregion comprises a solid solution of nitrogen in the substrate.

4. The method of claim 1 wherein the step of (c) is performed at a temperature within a range between about 350° C. to about 550° C.

5. The method of claim 1 wherein the volume of nitrogen in the step of (b) is between about 3-10%.

6. The method of claim 1 further comprising a step of:

(e) applying a first coating over the surface of the substrate.

7. The method of claim 1 wherein the step of (c) is performed by plasma nitriding.

8. The method of claim 1 wherein the cutting edge comprises a wedge-shaped tip that has an included angle of less than thirty degrees and a tip radius of less than 1,000 Angstroms.

9. The method of claim 2 wherein the cleaning gas mixture comprises a gas selected from the group consisting of hydrogen, argon, and combinations thereof.

10. The method of claim 3 wherein the mixed nitride-substrate interregion is substantially free of a compound layer.

11. The method of claim 6 wherein the first coating comprises a material selected from the group consisting of a metal, a metal alloy, a metal carbide, a metal oxide, a metal nitride, diamond, amorphous diamond, diamond-like carbon, boron, boron nitride, derivatives and combinations thereof.

12. The method of claim 6 further comprising a step of:

(f) applying a second coating over the first coating, wherein the second coating comprises a fluoropolymer-containing material.

13. The method of claim 11 wherein the metal is selected from the group consisting of Al, Ta, Ru, Ni, V, Ti, Pt, Cr, Nb, Hf, W, Zr, Ag, Re, Pd, Fe, and combinations thereof.

* * * * *